10/15/85 4,547,307

United States Patent [19]

Hoppe et al.

[11] Patent Number: 4,547,307

[45] Date of Patent: Oct. 15, 1985

[54] CAKE OF SOAP WITH DEODORIZING ACTION

[76] Inventors: Udo Hoppe, Lottbeker Weg 7, 2000 Hamburg 65; Klaus-Peter Wittern, Wurmkamp 19, 2000 Hamburg-Schenefeld; Gerhard Sauermann, Hambrook 4, 2351 Wiemersdorf; Otto Stelling, Grandweg 12, 2000 Hamburg 54; Manfred Rockl, Elbstrabe 5, 2000 Wedel/Holstein, all of Fed. Rep. of Germany

[21] Appl. No.: 418,814

[22] Filed: Sep. 16, 1982

[30] Foreign Application Priority Data

Sep. 17, 1981 [DE] Fed. Rep. of Germany ..... 3137017

[51] Int. Cl.[4] ..... C11D 3/48; C11D 9/50

[52] U.S. Cl. ..... 252/107; 252/132; 252/DIG. 16

[58] Field of Search ..... 252/106, 107, 132, 134, 252/89.1, DIG. 15

[56] References Cited

U.S. PATENT DOCUMENTS

| | | | |
|---|---|---|---|
| 2,478,820 | 8/1949 | Griffin | 260/410.6 |
| 3,069,358 | 12/1962 | Blodinger | 252/107 |
| 3,152,039 | 10/1964 | Mattson | 252/107 |
| 3,179,596 | 4/1965 | Farrar et al. | 252/125 |
| 3,224,976 | 12/1965 | Farrar et al. | 252/119 |
| 3,284,363 | 11/1966 | Bright | 252/107 |
| 3,431,207 | 3/1969 | Russell | 252/106 |
| 3,769,225 | 10/1973 | Matthaei | 252/134 |
| 3,835,057 | 9/1974 | Cheng et al. | 252/107 |
| 3,988,255 | 10/1976 | Seiden | 252/107 |

FOREIGN PATENT DOCUMENTS 1256283 2/1961 France .

OTHER PUBLICATIONS

Sagarin, E., "Cosmetics—Science & Technology", Second Edition, vol. 1, Wiley-Interscience, N.Y., pp. 182–184.

Barnett G., "Lanolin Derivatives and Modifications", (Part 2), Drug and Cosmetic Industry, Jun. 1957, pp. 744–745, 846–853.

*Primary Examiner*—Prince E. Willis

*Attorney, Agent, or Firm*—Jordan B. Bierman

[57] ABSTRACT

Cake of soap with deodorizing action which in addition to the usual additives contains as essential components, referred to 100 parts by weight of base soap, (a) 0.1 to 1 part by weight, preferably 0.2 to 0.5 part by weight, 3,4,4'-trichlorocarbanilide (TCC), (b) 1 to 4 parts by weight of an alkyl phenol polyglycol ether of the general formula wherein R is an alkyl radical with 6 to 12 carbon atoms and n stands for one of the numbers 10 to 16, and (c) 0.05 to 1 part by weight wool wax alcohol.

5 Claims, 1 Drawing Figure

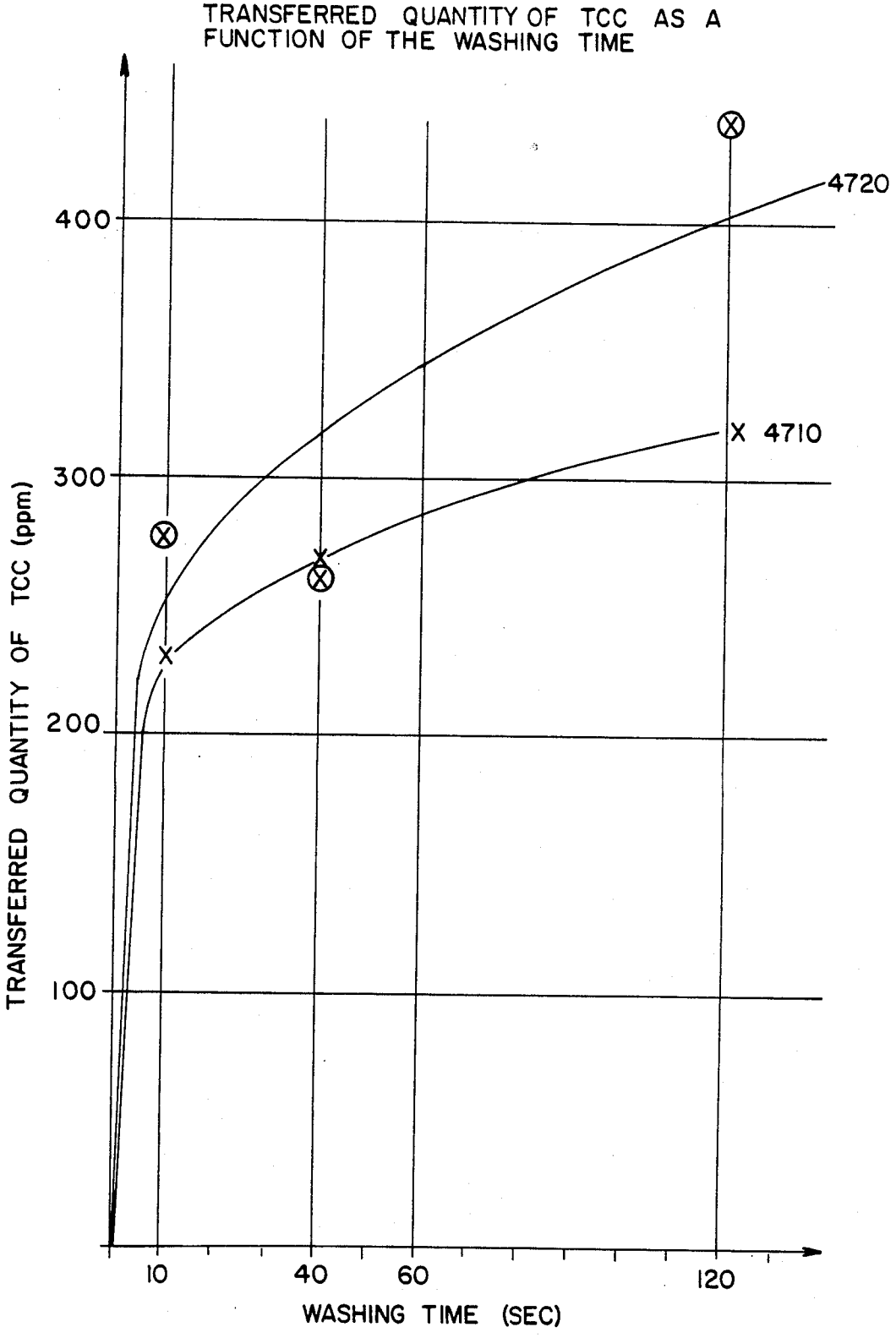
TRANSFERRED QUANTITY OF TCC AS A FUNCTION OF THE WASHING TIME
4720
X 4710
400
300
200
100
TRANSFERRED QUANTITY OF TCC (ppm)
10
40
60
120
WASHING TIME (SEC)

CAKE OF SOAP WITH DEODORIZING ACTION

The invention relates to a cake of soap with deodorizing action after washing, which contains as essential components 3,4,4'-trichlorocarbanilide (TCC) as antibacterial agent, an alkyl phenol polyglycol ether, as well as small amounts of wool wax alcohols.

It is known that the often unpleasant odor which in many people is connected with release of sweat (perspiration) is caused by bacterial decomposition of the at first odorless or weakly odorous sweat by the bacterial flora of the skin. To eliminate this evil, products are used in cosmetics which either reduce the release of body sweat at the surface of the skin (antiperspirants) or which attack and destroy that part of the bacterial skin flora which causes the decomposition of the sweat (deodorants). As agents with deodorizing action there have been proposed, besides roll-on sticks, deodorizing sticks and sprays, also cake soaps which due to certain additives exert deodorizing actions on the skin in the washing process.

While soap solutions as such already possess antibacterial properties, they are not sufficient to obtain the desired effect of an effective deodorization of the skin's surface. For deodorants in the form of cake soaps it is necessary, therefore, to provide them with antibacterial additives in order to obtain the desired action on the skin in the washing process. As substances which are suitable for incorporation in soaps, and which act on the bacterial skin flora and thus are able to bring about a disinfection and deodorization effect on the skin, there have been proposed among others halogenized phenols, such as 2,2'-dihydroxy-3,5,6,3',5',6'-hexachlorodiphenyl methans (hexachlorophene), or 3-trifluoromethyl-4,4'-dichloro-N,N'-diphenyl urea (Irgasan CF3). These are usually employed in soaps in quantities of about 1 to 2 wt.%. Apart from the fact that with respect to the use of hexachlorophene questions of health have recently been voiced, both substances do not have the high lightfastness necessary for use in cake soaps.

For this reason one has tried to replace said active substances by others, namely 3,4,4'-trichlorocarbanilide (TCC), the bacteriostatic, bactericidal and fungicidal properties of which were known. On incorporating this ingredient into base soap compositions it was found, however, that cake soaps produced therewith often have a sandy constitution because of the little soluble TCC powder employed.

It was an object of the invention to develop a cake of soap with deodorizing action on the skin after the washing process with a content of 3,4,4'-trichlorocarbanilide (TCC) which no longer presents the property of "sandiness" and the disadvantages connected therewith.

A further object of the invention was to provide a cake of soap with a content of 3,4,4'-trichlorocarbanilide sufficient to bring about good absorption on the skin and to cause a long-lasting disinfecting and deodorizing effect on the skin without causing irritation or an undesired alteration of the skin flora upon prolonged use.

It has been found, surprisingly, and herein lies the solution of the problem according to the invention, that this objective can be achieved with a cake of soap which in addition to a small quanrtity of 3,4,4'-trichlorocarbanilide (TCC) contains an alkyl phenol polyglycol ether as solubilizer and a small amount of wool wax alcohols.

The object of the invention thus is a cake of soap with deodorizing action having a content of 3,4,4'trichlorocarbanilide (TCC) as well as of common additives, which is characterized in that it contains, referred to 100 parts by weight of base soap, (a) 0.1 to 1 part by weight, preferably 0.2 to 0.5 part by weight, 3,4,4'-trichlorocarbanilide (TCC), (b) 1 to 4 parts by weight of an alkyl phenol polyglycol ether of the general formula

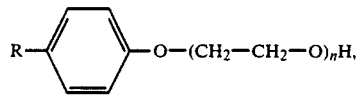

wherein R is an alkyl radical with 6 to 12 carbon atoms and n stands for one of the numbers 10 to 16 (=number of added ethylene oxide molecules), and (c) 0.05 to 1 part by weight of wool wax alcohols.

It could not be foreseen by the specialist and was therefore surprising that, by using an alkyl phenol polyglycol ether as solubilizer for the water-insoluble ingredient TCC, on the one hand any tendency of a cake of soap produced therewith to become "sandy" can be eliminated and, on the other hand, proportion of 0.13 or respectively 0.26 wt.% 3,4,4'-trichlorocarbanilide in the presence of the stated quantity of an alkyl phenol polyglycol ether (1 to 4 wt.%) in a cake of soap containing these components is sufficient to achieve on the skin, after washing, a degree of asepsis of the skin bacteria causing decomposition of the sweat and hence a deodorizing effect which otherwise can be obtained only at a much higher content of 3,4,4'-trichlorocarbanilide in such cake soaps (synergistic effect). This was confirmed in comparison tests carried out in a neutral institute in England.

Owing to this, the TCC content in the soap can be reduced by more than 50% (to about 75%) for achieving the desired deodorizing effect on the skin.

The energy-dispersive x-ray analysis of the content of Cl ions shows for soaps containing 1.3 wt.% TCC powder a strong inhomogeneity of the soap surface (cut) in contrast to soaps which contain 0.26 wt% solubilized TCC.

At the same time it was found, as could be verified by comparison tests on test persons, that, by additionally incorporating a small quantity of wool wax alcohols (component (c)) besides the active substance (TCC) and the alkyl phenol polyglycol ether into the soap, both the quantity of TCC transferred onto the skin can be significantly increased (improved bioavailability of the active substance on the skin) and also the strong degreasing (fat depletion) of the skin caused by the alkyl phenol polyglycol ether is eliminated or avoided.

In German Patent Application DE-OS No. 1,903,379, aqueous compositions for use as shampoos, skin cleanser and similar purposes are described which in addition to a detergent and a small quantity of lanolin oil contain about 0.3 to 1.5 wt.% of a water-insoluble bacteriostatic, which is to be preferably 3,4,4'-trichlorocarbanilide (TCC), as well as a non-ionic polyethoxylized organic compound which may consist of poly-ethoxylized lanolin alcohol, polyethoxylized sorbitan monooleate or polyethoxylized nonyl phenol. This non-ionic polyethoxylized organic compound is to serve as solubilizer for the purpose of making the agent used as bacteriostatic as well as the lanolin oil soluble in the aqueous solution of the detergent.

With respect to said solubilizers it is merely noted in DE-OS No. 1,903,379 that they practically do not influence the antibacterial activity of the bacteriostatic (TCC); nowhere in this earlier publication is there any mention of usability also in cake coaps, improved bioavilability of the active substance on the skin when they are included, let alone the combination effect discovered according to the invention upon incorporation of a combination of TCC, alkyl phenol polyglycol ethers and wool wax alcohols in soaps in a specific, fixed quantity proportion. To this must be added that while "lanolin oil" is a liquid wool fat fraction obtainable by fractional crystallization from wool fat, the wool wax alcohols used as component (c) according to the invention involve the unsaponifiable alcohol fraction of wool fat (wool wax) of a solid, waxy consistency obtainable in the saponification of wool fat (wool wax) with potash lye in alcohol.

The term "base soap" refers to the finished soap produced by boiling in the boiler from a fat batch of about 80 to 85% tallow and 15 to 20% coconut oil by saponification with soda lye and usually transformed into noodle or granulated form having a water content of about 11 to 14%, which in this form permits incorporation of the additives by extruding and pressing under the action of high shearing forces by means of suitable equipments, without the mass becoming too sticky or, conversely, too brittle. Thereafter—following homogeneous distribution of the additives in the soap mass—the mixture can be milled as usual and shaped into soap cakes.

Of the alkyl phenol polyglycol ethers of the above named general formula, which are employed as component (b) according to the invention, the nonyl phenol polyglycol ethers with 14 to 16 added ethylene oxide units per mole of nonyl phenol polyglycol ethers with 14 to 16 added ethylene oxide units per mole of nonyl phenol are preferred.

Conveniently the components (a) and (b) are added to the base soap in the form of a mixture of the two components in a quantity ratio of 1:5 to 1:10. Such a mixture is easy to prepare by simple batchwise introduction of TCC into the heated alkyl phenol polyglycol ether while stirring continuously. Preferably the obtained mixture of the two components (a) and (b) is stored above 25° C., in order, due to the liquid or pasty state prevailing at this temperature, to permit easier incorporation into the base soap.

Wool wax alcohols (component (c)) are the unsaponifiable alcohol components (alcohol fraction) of the wool wax (wool fat) which are obtained by dissociation of the wool wax (saponification with potash lye in alcohol and subsequent extraction with organic solvents). They constitute a light yellow to yellow brown, rather hard, waxy mass, plastic at elevated temperature, of melting point 54° to 60° C., which is of great technical importance in particular as emulsifier for the preparation of W/O emulsions.

Since soaps show O/W emulsifier properties by nature, the synergistic effect, of drastically increasing the bioavailability of the TCC by addition of the W/O emulsifiers wool wax alcohols, was entirely unexpected, the more so as the O/W emulsifier soap is present in great excess.

For the manufacture of the soap cakes, common additives can be added to the base soap in the normal quantities, referred to 100 parts by weight of base soap, such as overgreasing agents (1 to 3 wt.%), stabilizers (antioxidants, complexing agents) (0.05 to 0.5 wt.%), perfume (0.5 to 3 wt.%) and possibly dyes (0.05 to 0.3 wt.%) as well as skin protection agents such as sorbitol, glycerol or the like (1 to 5 wt.%).

The use of overgreasing agents in toilet soaps serves to relieve the degreasing of the human skin (regreasing) and to impart greater ductility to the soap cakes. In order not to adversely influence the color of the base soap, the overgreasing agents should be of light color to the extent possible or colorless; their consistency should be such that easy and uniform incorporation into the base soap mass in the kneader is made possible. To avoid undesired effects on the perfuming, overgreasing agents for soaps should further be odorless, or at least of weak odor, should not adversely effect the foaming power of the soap, but rather have a stabilizing effect on the foam and impart to it a dense and creamy structure. Besides, they should not be altered by alkali, light, or oxidative reactions. Overgreasing agents which can be used according to the invention are in particular wax esters difficult to saponify, such as lanolin (light-color purified wool fat) or neutral mineral oil products, such as vaseline and paraffin oil. In addition there can be used as overgreasing agents also fatty acids, fatty acid esters of polyalcohols, acetylized lanolin, ethoxylized lanolin derivatives, fatty alcohols, lecithin, as such or in mixture with the above named substances, as well as synthetically or semisynthetically produced acid- and alkali-stable liquid waxes and waxy compounds, such as oleic acid oleyl ester, decyl oleate or 2-octyl dodecanol. These are substances which do not interfere with O/W emulsification systems.

As antioxidants there may be used compounds, as for example 2,6-di-tert-butyl-4-methyl phenol, and as complexing agents (chelate formers) whose function it is to form with polyvalent metal ions water-soluble complexes, so-called chelates, and which as a result of this capacity increase the stability of the soaps to color and odor changes, substances such as the tetrasodium salt of ethylene diamine tetra-acetic acid (EDTA).

To perfume the soap cakes there are suitable such substances which are as stable as possible to alkali and which do not irritate the skin. As colorants—if necessary—one uses preferably pigments (water-soluble colorants are less suitable, as they often become unstable and usually are not lightfast).

The invention is explained more specifically below with reference to an example:

EXAMPLE 100 kg base soap in noddle form (manufactured by boiling in the boiler from a fat batch of 80 wt.% tallow and 20 wt.% coconut oil by saponification with soda lye) having a water content of 11 to 14%, which contained 0.35% common salt and 0.04% free alkalinity (determined as NaOH), were placed in a mixer with agitator and admixed with intensive stirring successively in and portions with 3.5 kg of a mixture of 0.5 kg 3,4,4'-trichlorocarbanilide (TCC) and 3.0 kg of a nonyl phenol polyglycol ether with an average ethoxylation degree of 15, 1.652 kg color paste and 1.3 kg perfume. The color paste consisted of a mixture (trituration) of:

0.60 kg paraffin oil
0.30 kg vaseline
0.60 kg wool wax alcohols
0.04 kg bees wax substitute (a product matched to the composition of natural bees wax of m.p. 62°-68° C.)

0.05 kg 2,6-di-tert-butyl-4-methylphenol ("lonol")
0.012 kg colorant
0.05 kg titanium dioxide After thorough mixing, the largely homogenized mixture was extruded three times using a vacuum double extrusion press and successively transformed into noodle form using a perforated disk before which knives rotate (knife cross). Thereafter the homogenous soap mass provided with the additives was milled, drawn by means of a heated orifice disk to form a cord which was cut into so-called blanks which then, after passing through a cooling canal, were pressed to form soap cakes.

The soap cakes thus produced showed after washing on the skin an excellent long-lasting deodorizing effect, which was better than the effect obtained by a placebo soap (without TCC) and just as great as the effect obtained by a 1.3% TCC soap.

TEST REPORT

The object of the study was the effect of the transfer rate of 3,4,4'-trichlorocarbanilide (TCC) solubilized with a nonyl phenol polyglycol ether having an average ethoxylation degree of 14.8—on human skin by the incorporation of a small quantity of wool wax alcohols in cakes of soap.

Examined were cakes of soap which contained, besides 0.26% TCC, 1.74% of the nonyl phenol polyglycol ether and 0.6% wool wax alcohols (4720) in comparison with such cakes of soap which had the same content of TCC and solubilizer, but had been made without addition of wool wax alcohols (4710), for their effectiveness of transferring TCC onto the skin. The results of these tests are shown graphically in the figure entitled Transfer Quantity of TCC as a Function of the Washing Time.

The washing times were varied: 9 test persons (7 female, 2 male) washed their left or right lower arm for 2 minutes, 7 female test persons for 40 seconds, and another 7 for 10 seconds. In addition, on one test person the soap consumption, efficiency of the existing TCC and the efficiency as a function of time were checked.

Result: After a washing time of 2 minutes, in all cases a significantly higher transferred quantity of TCC was found for the soap (4720) containing wool wax alcohols. The t value found when using the paired t test was 2,426, the stipulated value (S=95%) was 2,366.

The time response of the transfer reaction is evident from the digram. It shows the utilization of the TCC quantity present in the soap washed off. The soap consumption after a washing time of 30 seconds—washing of a lower arm—was 1.58 g, after 120 seconds=2 minutes: 6.175 g. The washed area was estimated as 1030 $cm^2$. The found quantities were: 0.9 $\mu g/cm^2$ or 0.93 mg/arm after 30 seconds and 1.0 $\mu g/cm^2$ or 1.03 mg/arm after 120 seconds. This represents a consumed TCC quantity of 4.1 mg or respectively 16.1 mg and an efficiency of about 23% (30 seconds) or respectively 6.4%/120 sec. As is further evident from the diagram, within the first 30 seconds 90% of the TCC found after 2 minutes is transferred.

It follows from this that the additional incorporation of 0.6% wool wax alcohols into the soap leads, as compared with a soap without this addition, to a significantly greater quantity of TCC transferred to the skin. This result was surprising and could not be foreseen by the specialist.

In a further experiment it was determined that the TCC transfer rate in the washing process (as described above) with a deo(dorant) soap according to the invention containing only 0.26% TCC is just as good as the transfer rate which (was obtained) with a soap containing 1.3% TCC in which the TCC had not been made more bioavailable by wool wax alcohols and solubilization.

We claim:

1. A deodorizing cake of soap comprising
(a) 100 parts by weight of a base soap,
(b) 0.1 to 1 part by weight of 3,4,4'-trichlorocarbanilide,
(c) 1 to 4 parts by weight of an alkyl phenol polyglycol ether of the general formula

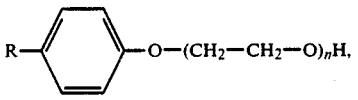

wherein R is an alkyl radical having 6 to 12 carbon atoms and n is 10 to 16, and
(d) 0.05 to 1 part by weight of wool wax alcohols.

2. The soap of claim 1 wherein said trichlorocarbanilide is present in an amount of 0.2 to 0.5 parts by weight.

3. The soap of claim 1 wherein said trichlorocarbanilide and said polyglycol ether are present in a ratio of 1:5 to 1:10.

4. The soap of claim 1 wherein said base soap is produced by boiling the fat batch derived from the saponification of 80 to 85% tallow and 15 to 20% coconut oil with soda lye.

5. The soap of claim 1 wherein said base soap has a water content of about 11 to about 14%.

* * * * *